US006138763A

United States Patent [19]

Beauquin

[11] Patent Number: 6,138,763

[45] Date of Patent: Oct. 31, 2000

[54] METHOD FOR PUMPING A FLUID

[75] Inventor: Jean-Louis Beauquin, Saint-Faust, France

[73] Assignee: Elf Exploration Production, Coubevoie, France

[21] Appl. No.: 09/142,168

[22] PCT Filed: Jan. 28, 1998

[86] PCT No.: PCT/FR98/00156

§ 371 Date: May 17, 1999

§ 102(e) Date: May 17, 1999

[87] PCT Pub. No.: WO98/32950

PCT Pub. Date: Jul. 30, 1998

[30] Foreign Application Priority Data

Jan. 29, 1997 [FR] France ..... 97 00958

[51] Int. Cl.[7] ..... E21B 43/12

[52] U.S. Cl. ..... 166/372; 166/374; 166/68

[58] Field of Search ..... 166/63, 68, 325, 166/369, 370, 372, 373, 374, 375

[56] References Cited

U.S. PATENT DOCUMENTS

| | | | |
|---|---|---|---|
| 1,499,509 | 7/1924 | Dunn . | |
| 3,215,087 | 11/1965 | McLeod, Jr. . | |
| 3,814,545 | 6/1974 | Waters | 417/90 |
| 4,025,235 | 5/1977 | Newbrough | 417/54 |
| 4,267,885 | 5/1981 | Sanderford | 166/250 |
| 4,275,790 | 6/1981 | Abercrombie | 166/372 |
| 4,410,041 | 10/1983 | Davies et al. | 166/250 |
| 4,546,830 | 10/1985 | McLaughlin et al. | 166/370 |
| 4,649,994 | 3/1987 | Chaudot | 166/68 |
| 5,337,828 | 8/1994 | Jennings, Jr. | 166/372 |
| 5,407,010 | 4/1995 | Herschberger | 166/372 |
| 5,915,478 | 6/1999 | Brown et al. | 166/329 |

FOREIGN PATENT DOCUMENTS

| | | | |
|---|---|---|---|
| 0 579 497 | 1/1994 | European Pat. Off. | E21B 43/36 |
| 2 460 273 | 1/1981 | France . | |

*Primary Examiner*—Frank S. Tsay
*Attorney, Agent, or Firm*—Blank Rome Comisky & McCauley

[57] ABSTRACT

The invention concerns a method for pumping a fluid, for instance an oil effluent derived from a source adjacent to a well, towards an outlet, the well comprising a chamber extending substantially over the whole length of the well, and a pipe column passing through the chamber and communicating with it at one end, and, at an intermediate point on its length with the source. The invention comprises the following steps: filling, up to a predetermine height, the lower end of the chamber and of the pipe column with a first liquid with a density higher than that of the effluent; filling the chamber, between the predetermined height and the outlet, with a second liquid with a density lower than that of the first liquid, and injecting an additional amount of the second liquid in the chamber so as to displace the first liquid and the effluent, in order to bring the effluent up towards the outlet. The invention also concerns a pumping installation.

3 Claims, 3 Drawing Sheets

METHOD FOR PUMPING A FLUID

BACKGROUND OF THE INVENTION

1. Field of the Invention

The present invention relates to a method for pumping a fluid and, more specifically, to a method for pumping or raising hydrocarbons from an oil well.

The present invention also relates to an installation for pumping a liquid from an underground source.

2. Description of the Related Art

In some oil wells, the natural flow of hydrocarbons from the bottom to the surface is not sufficient to allow or to sustain commercial production. This is due either to the viscosity or weight of the effluents, or to a natural pressure at the bottom of the well which is too low in comparison with the factors which oppose the raising of these effluents to the surface. In order to allow the well to be exploited on a commercial scale it is advisable to use a system for artificially raising the effluent, or a well-activation system. For example, a pump may be mounted at the lower end of a production tube located in the well, or an installation for injecting gas into the bottom of the well may be provided. The latter type of installation, more commonly known as a gas lift, is used to lighten the column of hydrocarbons located in the well in order to make it easier to raise to the surface.

However, the use of a pump at the bottom of a well, a place where the temperatures and pressures are very high and where the surrounding environment may be very corrosive, may lead to breakdowns and malfunctions of the activation equipment which, bearing in mind its location within the well, require lengthy and expensive interventions. Furthermore, the production of the well is halted during these interventions, and this leads to additional financial losses. An installation for injecting gas into the bottom of a well is more reliable than the previous installation, but has the drawback of requiring a source of pressurized gas, for example a compressor with its associated pipework, on an isolated site.

Another assistance system consists in pumping hydrocarbons in from the surface. Document EP-A-579497 describes a method for pumping liquid, from one end of a well to an outlet at the opposite end of the well, in which method the pressure of gas in one or more chambers is regulated in such a way that these chambers fill with liquid. Next, a higher gas pressure is applied to each chamber so as to displace the liquid and convey it towards the outlet. Each chamber is fitted with inlet and outlet valves controlled from level detectors so as to control the direction of flow of the liquid. According to this document, the chambers may either be superimposed on one another within the well, or placed side by side at a point next to the well outlet.

Positioning the chambers so that they are superimposed in the well has advantages in that it makes it possible to have an installation which is less bulky and an optimized efficiency. By contrast, this type of installation has drawbacks because superimposing the chambers, each fitted with various valves and level detectors, requires one or more chambers to be withdrawn from the well when there is a breakdown or failure in one of the lower chambers. Furthermore, the use of several chambers, each fitted with valves and with level detectors, makes scheduling installation maintenance difficult.

Document U.S. Pat. No. 1,499,509 describes a method for pumping an effluent from a not-very-eruptive oil well.

According to this method, the effluent fills an annular space defined between the wall of the well and a production tubing which extends from the bottom of the well right up to the surface. Once the annular space is filled with effluent, pressurized gas is conveyed from the surface into the top end of this space, and this displaces the effluent and causes it to rise up as far as the surface, inside the tubing.

This method has drawbacks in that it requires substantial installations for compressing, treating and transporting gas. Furthermore, the pumping energy is, for the most part, dissipated as heat, the result of this being that it appreciably reduces the efficiency of the method.

SUMMARY OF THE INVENTION

The subject of the present invention is therefore a method for pumping a fluid from a source at one end of a well to an outlet, which method is simple, reliable and allows use of an installation situated at the surface and which is not very bulky.

To achieve this, the invention proposes a method for pumping a fluid effluent from a source (14) adjacent to a well (10) to an outlet (24), the well comprising a chamber (32) extending substantially along the length of the well, and a tubing (18) passing through the chamber and communicating, at one end, with this chamber and, at an intermediate point along its length, with the source(14), characterized in that this method comprises the following stages:

filling the lower end of the chamber and of the tubing up to a predetermined height with a first liquid of higher density than the effluent;

filling the chamber, between the predetermined height and the outlet, with a second liquid of lower density than the first liquid, and injecting an additional quantity of the second liquid into the chamber so as to displace the first liquid and the effluent, in order to raise the effluent up to the outlet.

The present invention therefore has the advantage of calling upon an installation in which the power unit is located at the surface, thus making its maintenance very easy and infrequent, and which is effective and reliable.

The subject of the present invention is also a pumping installation that allows use of the pumping method.

To achieve this, the invention proposes an installation for pumping a liquid effluent from an underground source (14) comprising a well (10) extending from the surface (12) through the source and comprising a chamber (32) extending along its entire length, a tubing (18) placed in the chamber and communicating with this chamber at its lower end and, at an intermediate point along its length, with the source (14), characterized in that the chamber (32) and the tubing (18) are designed to be filled, to a predetermined height, with a first liquid of higher density than the effluent, the installation additionally comprising a series of valves (38) intended to place the chamber (32) selectively in communication with a pressurized source of a second liquid of lower density than the first liquid, and in communication with a low-pressure reservoir for this first liquid.

Other features and advantages of the present invention will become clear from reading the following description given by way of non-limiting explanation, with reference to the appended drawings.

BRIEF DESCRIPTION OF THE FIGURES OF DRAWINGS

FIG. 1 is a diagrammatic sectional view of a well according to a first embodiment of the invention; and FIG. 2 is a diagrammatic sectional view of a second embodiment.

DETAILED DESCRIPTION OF THE PREFERRED EMBODIMENT

Figure 1:
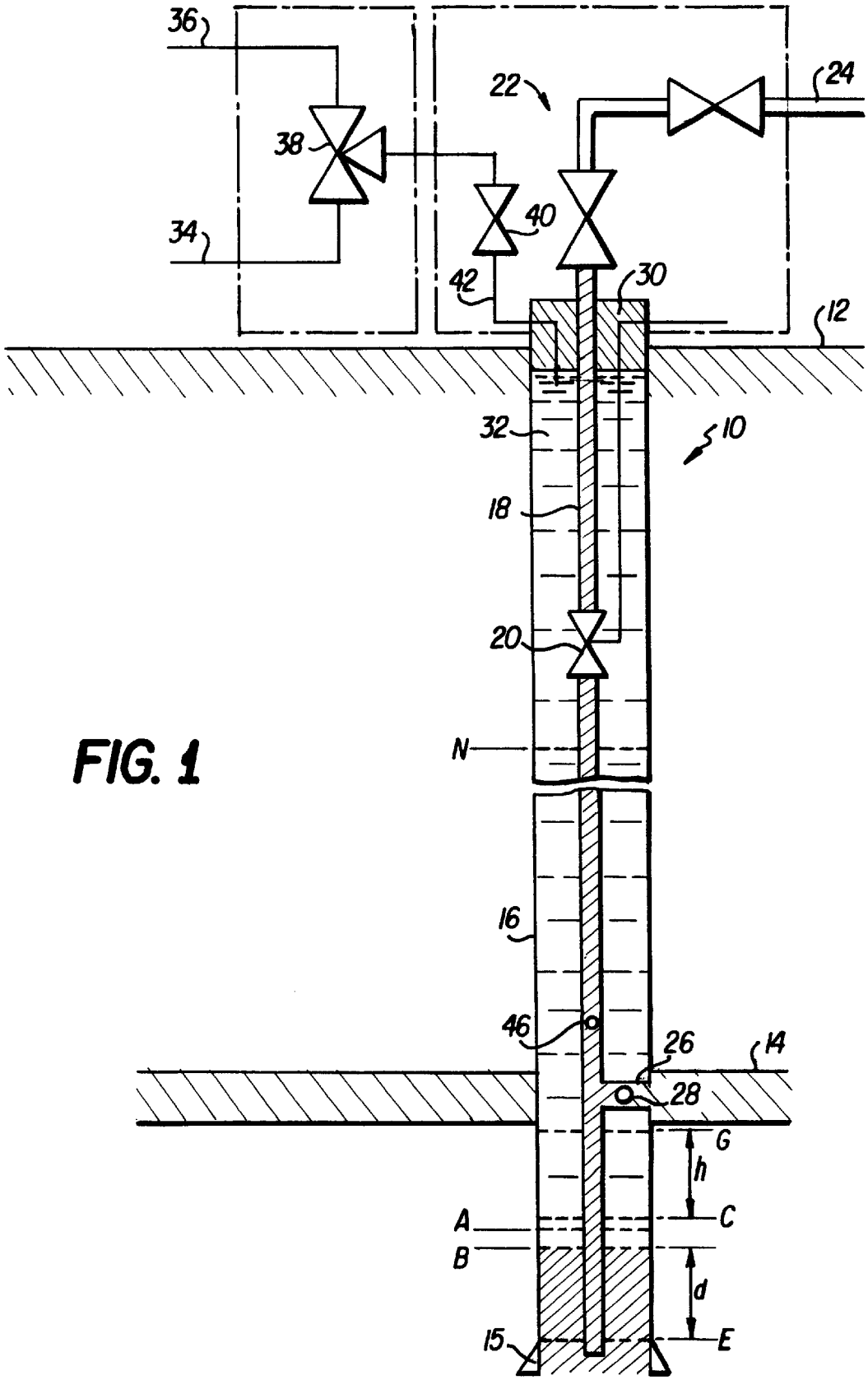

In FIG. 1, a well depicted overall as 10 which, in the example illustrated, is an oil well, extends from the surface 12 of the ground through a layer of oil-bearing rock 14. The lower end 15 of the well is situated approximately XX m below the layer of rock 14. The well 10 has a casing 16 extending along the well, and a production tubing 18 extending from the surface 12 as far as the lower end 15 of the well. The tubing 18 comprises, at a point approximately 100 m from the surface 12, a safety valve 20. At its upper end, the tubing 18 has a series of production valves 22, or "Christmas tree" intended to control the production rate of the well. This series of valves communicates with a production pipe 24 forming the well outlet.

The well 10 and the tubing 18 extend beyond the layer of oil-bearing rock 14, the tubing 18 opening into this rock via a pipe 26 fitted with a non-return valve 28. The upper end of the well 10 is closed by a seal 30 for suspending the tubing or "tubing hanger". The annular space 32 defined between the casing 16 and the tubing 18 may be selectively placed in communication with a high-pressure liquid source 34 and a low-pressure liquid reservoir 36 by a series of control valves 38, safety valves 40 and a pipe 42 which passes through the seal 30. A safety valve 44 may advantageously be mounted at the end of the pipe 42. A non-return valve 46, placed in the tubing 18 at a point immediately above the pipe 26, allows fluid to flow through the tubing only from the bottom towards the surface.

The pool in the layer 14 is not very eruptive, that is to say that the pressure exerted by the pool allows the effluent to be raised to an intermediate level N in the well. In order to raise the effluent to the level N as far as the surface, the pumping method according to the invention is used.

This method consists in placing a first liquid, of high density, at the lower end of the well so that it fills the annular space and the lower end of the tubing 18 up to a level A. Then, the empty volume of the annular space 32 is entirely filled with a second liquid from the high-pressure source 34 and of lower density than the first liquid. The pressure exerted by the second liquid causes the level of the first liquid to drop, in the annular space 32, from the level A to a lower level B, the result of this being that the level of the first liquid in the tubing 18 rises from the level A to a higher level C. The interior of the tubing 18 between the level C and the level N contains effluent from the layer of rock 14.

Next, in order to displace the effluent in the tubing 18 towards the surface, an additional volume of the second liquid is conveyed into the annular space, the result of this being to drop the level of the first liquid by a distance d from the level B down to a lower level E. This lower level is slightly above the open end of the tubing 18. The level of the first liquid rises, by a distance h, as far as a maximum level G, just below the pipe 26. Then, in order to complete a pumping cycle, the control valve 38 is operated to place the annular space 32 in communication with the low-pressure reservoir 36. The static pressure exerted by the column of the first liquid in the tubing 18 on the second liquid delivers this latter liquid into the low-pressure reservoir 36, the liquids tending to return to their starting levels B and C. The effluent which has been raised in the tubing towards the surface has no opportunity of dropping back down because of the action of the non-return valve 46. When the first liquid in the tubing drops back from its maximum level G to its level C, it creates a depression in the tubing 18, below the non-return valve 46, and this tends to increase the speed at which the effluent flows from the rock 14 into the tubing 18.

Once the liquids have reverted to their starting levels B and C, and the tubing below the non-return valve 46 is filled with effluent, the pumping cycle can recommence, simply by reversing the position of the control valve 38 in order to place the annular space 32 back in communication with the high-pressure source 34. On each pumping cycle, the effluent is raised up the tubing 18 by a height h.

The use of the first liquid of high density allows it to act as a return spring for the second liquid of lower density. By reverting to its starting level at the end of a cycle, the first liquid delivers the second liquid to the low-pressure reservoir and allows a further quantity of effluent to enter the tubing. The increase in size of the compressor used to feed the high-pressure source with the second liquid, which is needed by the additional charge of the first liquid is small, the size of this compressor being nonetheless smaller than the one needed for a pumping method using a gas, as described in document U.S. Pat. No. 1,499,509.

Figures 2A, 2B, 2C, 2D:
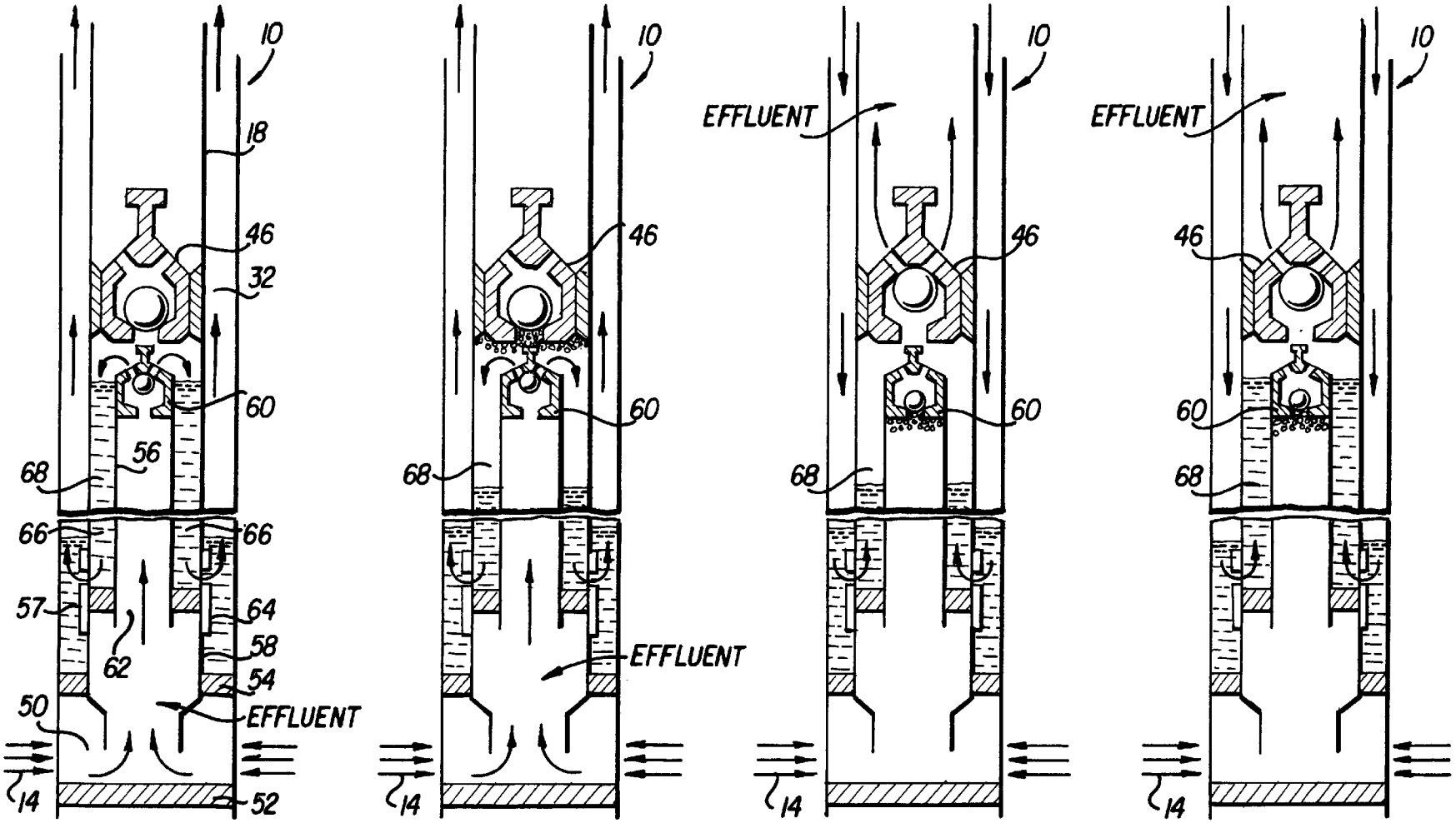
Figure 3D:
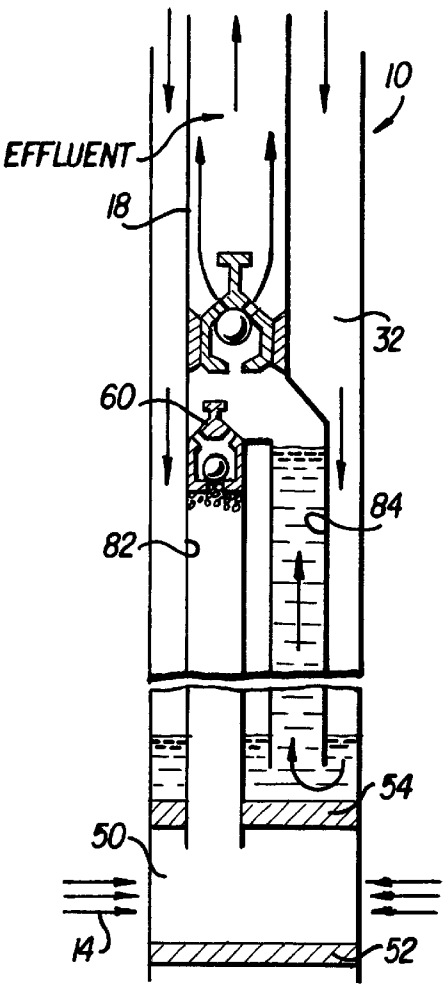
Figure 3C:
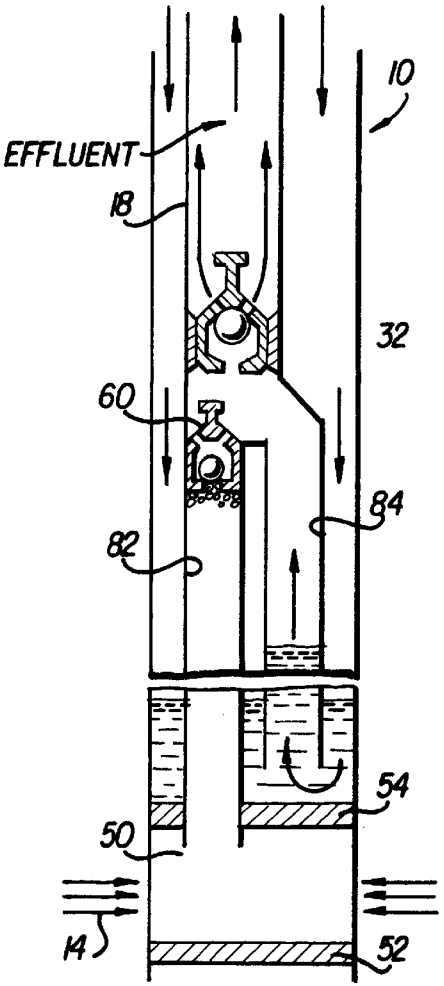
Figure 3B:
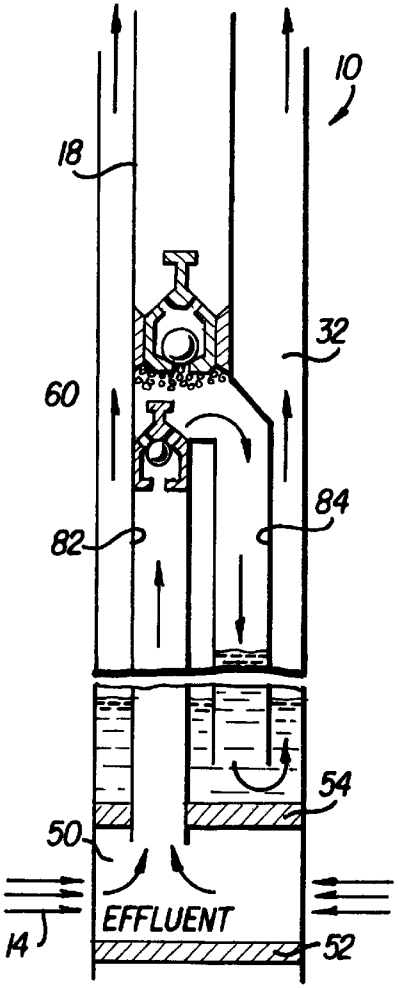
Figure 3A:
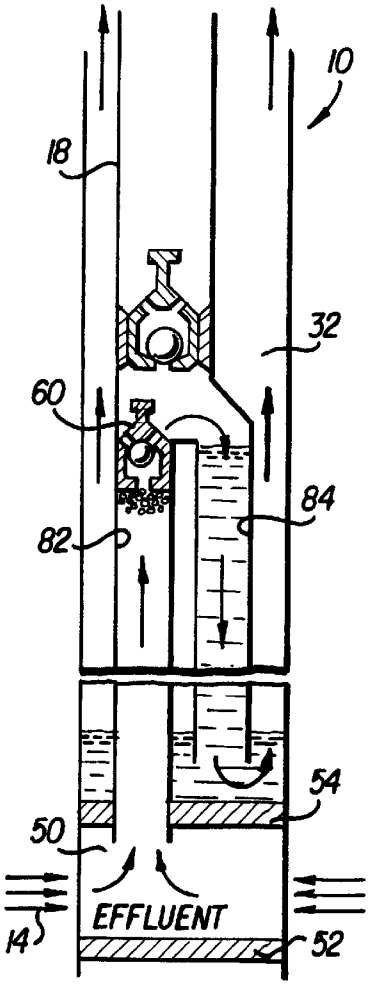

FIG. 2 depicts a second embodiment which differs from that of FIG. 1 in that it comprises a first casing 16 and a second casing 50 which define between them an annular chamber 52 delimited by two annular seals 55 and 56. The annular chamber is open towards the layer of oil-bearing rock 14 and communicates via a pipe 58 fitted with a non-return valve 60, with a chamber 62 placed outside the tubing 18. The tubing 18 has two openings 64 towards the chamber 62 and, in addition, is fitted with a non-return valve 66 at a point immediately above the chamber 62. The pumping method using this embodiment is approximately the same as the one employed in the installation of FIG. 1.

The installation for pumping a liquid effluent shown in FIGS. 2A to 2D is intended to be used on existing wells, that is on wells already fitted with a production tubing. FIGS. 3A to 3D show an installation for pumping liquid effluent which is adapted to be installed on a well which has not yet been completed or on one on which the production tubing is intended to be changed.

At a point in the well 10, the tubing separates into two parallel tubes 82, 84, of which one 82, extends through a packer 54 and communicates with chamber 50, and the other, 84, communicates with the annular space 32 at a point preferably immediately above packer 54. Tube 82 is fitted with a non-return valve 60 which causes the effluent to flow only in the direction of arrow 62.

The method of pumping the effluent used in the installation of FIG. 3 is similar to that used with the installation of FIG. 2.

NUMERICAL EXAMPLE

As the method for pumping according to the invention uses liquid as a pumping means, the loss of pumping energy in thermodynamic phenomena is considerably reduced. Furthermore the use of the first liquid of high density, which tends to revert to its starting level by delivering the second pumping liquid to its reservoir, further reduces the energy consumption of the method.

What is claimed is:

1. Method for pumping a fluid effluent from a source adjacent to a well to an outlet, the well comprising a chamber extending substantially along the length of the well, and a tubing passing through the chamber and communicating, at one end, with this chamber and, at an intermediate point along its length, with the source, this method comprising the following stages:

filling the lower end of the chamber and of the tubing up to a predetermined height with a first liquid of higher density than the effluent;

filling the chamber, between the predetermined height and the outlet, with a second liquid of lower density than the first liquid; and injecting an additional quantity of the second liquid into the chamber so as to displace the first liquid and the effluent, in order to raise the effluent up to the outlet.

2. Method according to claim 1, comprising the additional stage of placing the chamber in communication with a low-pressure reservoir of second liquid so as to allow the second liquid to flow out of the chamber, the first liquid running down inside the tubing towards its predetermined height.

3. Installation for pumping a liquid effluent from an underground source comprising a well extending from the surface through the source and comprising a chamber extending along its entire length, a tubing placed in the chamber and communicating with this chamber at its lower end and, at an intermediate point along its length, with the source, wherein the chamber and the tubing are designed to be filled, to a predetermined height, with a first liquid of higher density than the effluent, the installation additionally comprising a series of valves intended to place the chamber selectively in communication with a pressurized source of a second liquid of lower density than the first liquid, and in communication with a low-pressure reservoir for this first liquid.

* * * * *